US011913466B2

(12) United States Patent
Kyo et al.

(10) Patent No.: US 11,913,466 B2
(45) Date of Patent: Feb. 27, 2024

(54) PUMP AND ROTARY BAFFLE PLATE

(71) Applicant: EBARA CORPORATION, Tokyo (JP)

(72) Inventors: Seigo Kyo, Tokyo (JP); Yoichi Nakamura, Tokyo (JP); Akinori Murata, Tokyo (JP); Soichiro Ogawa, Tokyo (JP); Dong Min Kim, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/757,267

(22) PCT Filed: Dec. 16, 2020

(86) PCT No.: PCT/JP2020/046853
§ 371 (c)(1),
(2) Date: Jun. 13, 2022

(87) PCT Pub. No.: WO2021/125197
PCT Pub. Date: Jun. 24, 2021

(65) Prior Publication Data

US 2023/0003226 A1 Jan. 5, 2023

(30) Foreign Application Priority Data

Dec. 16, 2019 (JP) ..... 2019-226550

(51) Int. Cl.
*F04D 29/12* (2006.01)
*F04D 29/04* (2006.01)
(Continued)

(52) U.S. Cl.
CPC ..... *F04D 29/12* (2013.01); *F04D 29/043* (2013.01); *F04D 29/22* (2013.01)

(58) Field of Classification Search
CPC ..... F04D 29/12; F04D 29/22; F04D 29/043; F04D 29/126; F04D 29/2261;
(Continued)

(56) References Cited

U.S. PATENT DOCUMENTS 5,609,468 A 3/1997 Burgess
6,568,688 B1 * 5/2003 Boeck ..... F16J 15/162 277/411
(Continued)

FOREIGN PATENT DOCUMENTS

JP H60-178391 U 11/1985
JP S61-212695 A 9/1986
(Continued)

OTHER PUBLICATIONS

Machine Translation JP 2010-019084 (Year: 2023).*
(Continued)

*Primary Examiner* — Mark A Laurenzi
*Assistant Examiner* — Dapinder Singh
(74) *Attorney, Agent, or Firm* — PEARNE & GORDON LLP

(57) ABSTRACT

To eliminate accumulation of air while preventing a decrease in pump efficiency, a pump is provided. The pump includes a rotary shaft, an impeller that is attached to the rotary shaft and that rotates with rotation of the rotary shaft, a casing that surrounds the rotary shaft, a shaft sealing device that seals a gap between the casing and the rotary shaft, and a baffle plate part that is located between the impeller and the shaft sealing device and attached to a rotating body. The baffle plate part extends in a direction that is inclined or orthogonal with respect to a surface orthogonal to an axial direction of the rotary shaft.

7 Claims, 14 Drawing Sheets

(51) Int. Cl.
*F04D 29/043* (2006.01)
*F04D 29/22* (2006.01)

(58) Field of Classification Search
CPC ..... F04D 29/2222; F04D 29/0473; F04D 29/181; F04D 29/167; F04D 9/002; F04D 1/00; F04D 17/08; F04D 17/00; F04D 7/02; F05D 2240/55
See application file for complete search history.

(56) References Cited

U.S. PATENT DOCUMENTS

| | | | | |
|---|---|---|---|---|
| 10,119,420 | B2 * | 11/2018 | Scothern | F01D 11/003 |
| 11,248,492 | B2 * | 2/2022 | Polly | F01D 25/16 |
| 2019/0323382 | A1 * | 10/2019 | Pankratov | F01D 25/183 |
| 2020/0173339 | A1 * | 6/2020 | Russalian | H02K 21/24 |
| 2020/0370561 | A1 * | 11/2020 | Barrow | F04D 29/622 |

FOREIGN PATENT DOCUMENTS

| | | | |
|---|---|---|---|
| JP | S62-111994 | A | 7/1987 |
| JP | H08-100782 | A | 4/1996 |
| JP | H08-296587 | A | 11/1996 |
| JP | 2010-019084 | A | 1/2010 |
| JP | 2011-163264 | A | 8/2011 |

OTHER PUBLICATIONS

International Search Report dated Mar. 2, 2021 issued in Patent Application No. PCT/JP2020/046853.
Written Opinion dated Mar. 2, 2021 issued in Patent Application No. PCT/JP2020/046853.
Extended European search report issued in European Patent Application No. 20902030.4 dated Dec. 11, 2023.

* cited by examiner

PUMP AND ROTARY BAFFLE PLATE

TECHNICAL FIELD

The present invention relates to a pump and a rotary baffle plate.

BACKGROUND ART

A conventional vertical centrifugal pump includes, for example, a rotary shaft extending in a vertical direction, an impeller rotating with the rotary shaft, a casing surrounding the impeller and the rotary shaft, and a mechanical seal sealing a gap between the casing and the rotary shaft. When this type of pump is primed with water before being operated, part of air in the pump remains and air is accumulated around the mechanical seal.

When the pump is operated with air accumulated, failure might occur in the mechanical seal. Specifically, air has a density smaller than that of water, and therefore receives a smaller centrifugal force from rotation of the impeller. As a result, water is pushed outward from the casing, and air gathers near the rotary shaft. Since the mechanical seal is provided near the rotary shaft, the mechanical seal is in dry operation during the operation of the pump, generates heat due to insufficient lubrication, and might burn at the worst case.

To eliminate such accumulation of air, a pump configured to pour water into the accumulation of air by eliminating a pressure difference between an interior of the impeller and the accumulation of air is known (e.g., PTL 1). Specifically, in this pump, a small hole is provided in a main plate of the impeller to eliminate the pressure difference between the interior of the impeller and the accumulation of air.

In addition, a pump including a housing in which a flow path communicating between a discharge port of the pump and a mechanical seal is formed is also known (e.g., PTL 2).

CITATION LIST

Patent Literature

PTL 1: Japanese Utility Model Laid-Open No. 60-178391
PTL 2: Japanese Utility Model Laid-Open No. 62-111994

SUMMARY OF INVENTION

Technical Problem

In a pump disclosed in PTL 1, liquid returns from a mechanical seal side through a hole in a main plate back into an impeller, and hence a pump efficiency might decrease. In a pump disclosed in PTL 2, if there is a foreign object inside the pump, a flow path might be blocked with the foreign object. Furthermore, liquid flows backward from a discharge port of the pump to a mechanical seal side, the pump efficiency might decrease in the same manner as in PTL 1.

One of objects of the present invention, which has been made in view of the above problems, is to eliminate accumulation of air while preventing a decrease in pump efficiency.

Solution to Problem

According to one aspect of the present invention, a pump is provided. The pump includes a rotary shaft, an impeller that is attached to the rotary shaft and that rotates with rotation of the rotary shaft, a casing that surrounds the rotary shaft, a shaft sealing device that seals a gap between the casing and the rotary shaft, and a baffle plate part that is located between the impeller and the shaft sealing device and attached to a rotating body. The baffle plate part extends in a direction that is inclined or orthogonal with respect to a surface orthogonal to an axial direction of the rotary shaft.

According to another aspect of the present invention, a rotary baffle plate that is attached to a rotary shaft so as to be located between an impeller and a shaft sealing device in a pump is provided. The rotary baffle plate includes a main body part including an opening into which the rotary shaft is inserted, and attached to the rotary shaft, and a baffle plate part attached to the main body part and extending in a direction that is inclined or orthogonal with respect to a surface orthogonal to an axial direction of the rotary shaft in a state where the main body part is attached to the rotary shaft.

DESCRIPTION OF EMBODIMENTS

Figure 1:
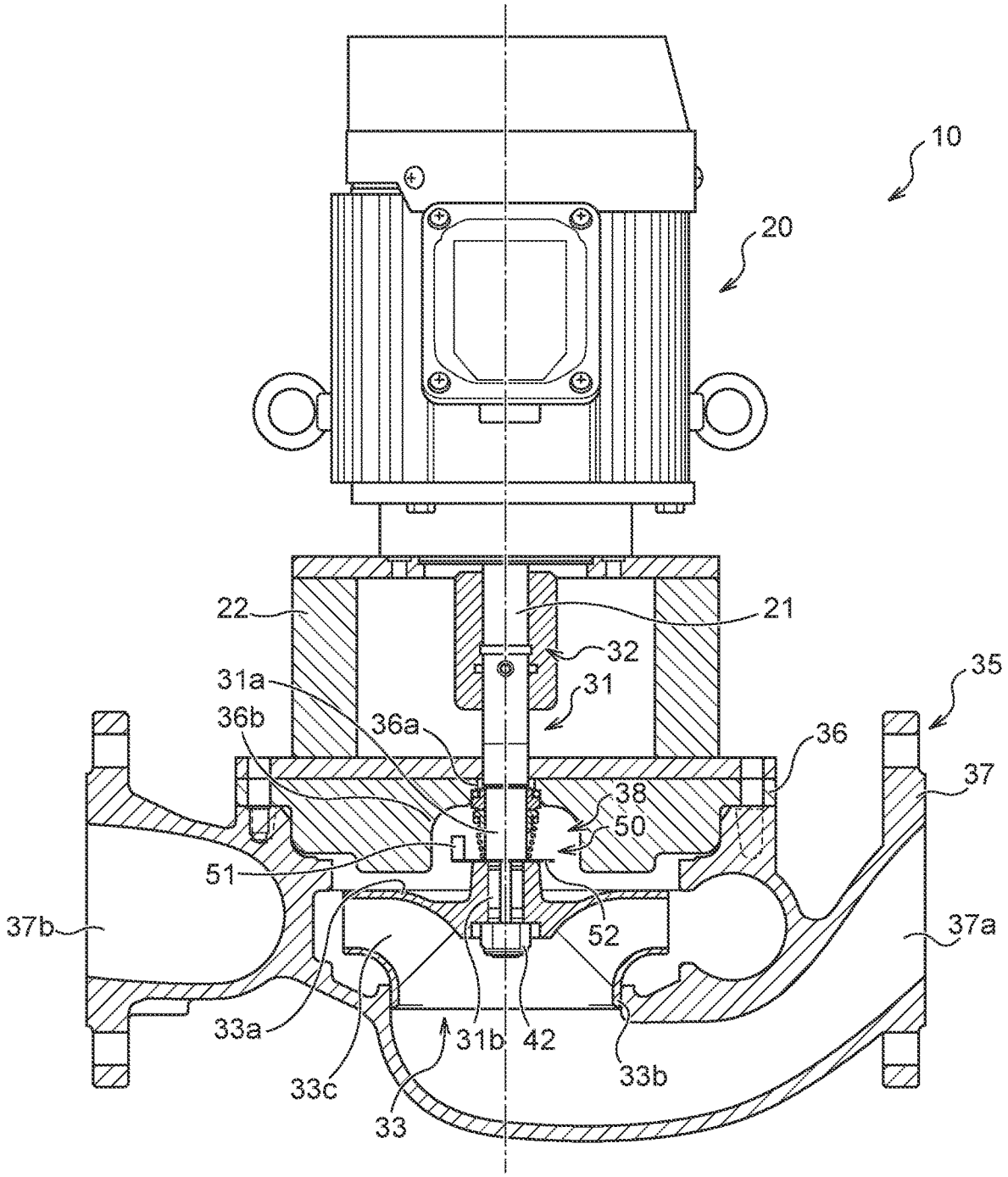
FIG. 1 is a partial side cross-sectional view of a pump according to the present embodiment.

Hereinafter, embodiments of the present invention will be described with reference to the drawings. In the drawings described below, the same or corresponding constituent elements are denoted with the same reference sign and are not redundantly described. In the embodiments described below, a vertical centrifugal pump is described as an example of a pump of the present invention, but is not limited, and any pump to which the present invention is applicable may be included in the present invention.

FIG. 1 is a partial side cross-sectional view of a pump according to the present embodiment. FIG. 1 shows a motor 20 only in a side view and other parts in a cross-sectional view. As shown, a pump 10 includes the motor 20, a rotary shaft 31, an impeller 33, and a casing 35. The motor 20 comprises a motor spindle 21 extending in a vertical direction and is fixed to a motor base 22 fixed to the casing 35.

An end of the motor spindle 21 and one end of the rotary shaft 31 are coupled by a coupling part 32. Thus, power of the motor 20 is transmitted to the rotary shaft 31 via the motor spindle 21 and the coupling part 32, and the rotary shaft 31 rotates in a circumferential direction. The impeller 33 is fixed at the other end of the rotary shaft 31. Specifically, as shown in FIG. 1, the rotary shaft 31 includes a large diameter portion 31*a* and a small diameter portion 31*b* located on a tip side of the large diameter portion 31*a*. The small diameter portion 31*b* of the rotary shaft 31 engages with the impeller 33 via a key. With the small diameter portion 31*b* of the rotary shaft 31 inserted into the impeller 33, the impeller 33 is fixed to the rotary shaft 31 by a bolt 42. The impeller 33 includes a main plate 33*a* located on a motor 20 side (mechanical seal 38 side described later), a side plate 33*b* and a plurality of wings 33*c* provided between the main plate 33*a* and the side plate 33*b*.

The casing 35 includes an upper casing 36 and a lower casing 37. The upper casing 36 has an opening 36*a* into which the rotary shaft 31 is inserted. The pump 10 includes, between the opening 36*a* of the upper casing 36 and the rotary shaft 31, the mechanical seal 38 (corresponding to an example of a shaft sealing device) that seals a gap between the upper casing 36 and the rotary shaft 31. The upper casing 36 includes a mechanical chamber 36*b* for storing the mechanical seal 38.

The lower casing 37 is configured to house the impeller 33 and a part of the rotary shaft 31 inside. Further, the lower casing 37 includes a suction port 37*a* through which liquid is introduced into the lower casing 37 and a discharge port 37*b* through which the liquid introduced into the lower casing 37 is discharged.

In the pump 10 having the shown configuration, the rotary shaft 31 is rotated by torque given from the motor 20, and the impeller 33 rotates with the rotary shaft 31. The liquid is introduced into the pump 10 through the suction port 37*a* of the lower casing 37, boosted by the rotating impeller 33, and then discharged through the discharge port 37*b* to outside of the pump 10.

As described above, when the pump 10 is primed with water before being operated, an interior of the casing 35 of the pump 10 cannot be filled with water, and air is accumulated inside the mechanical chamber 36*b*, that is, around the mechanical seal 38. When the pump 10 is operated in this state, water present on a back side of the main plate 33*a* of the impeller 33 moves in the circumferential direction with the rotation of the impeller 33.

Pumps of recent years may have a rotation speed controlled by an inverter. When the impeller 33 rotates at a relatively high rotation speed (e.g., 3000 rpm), the water on the back side of the main plate 33*a* also moves in the circumferential direction at a relatively high speed. Therefore, with this movement of water, air in the mechanical chamber 36*b* also moves in the circumferential direction, and the air in the mechanical chamber 36*b* may be discharged with water. However, when the pump 10 is operated at a relatively low rotation speed (e.g., 450 rpm), the water on the back side of the main plate 33*a* does not move in the circumferential direction for discharging air in the mechanical chamber 36*b*, and the air in the mechanical chamber 36*b* cannot be discharged.

Figure 2A:
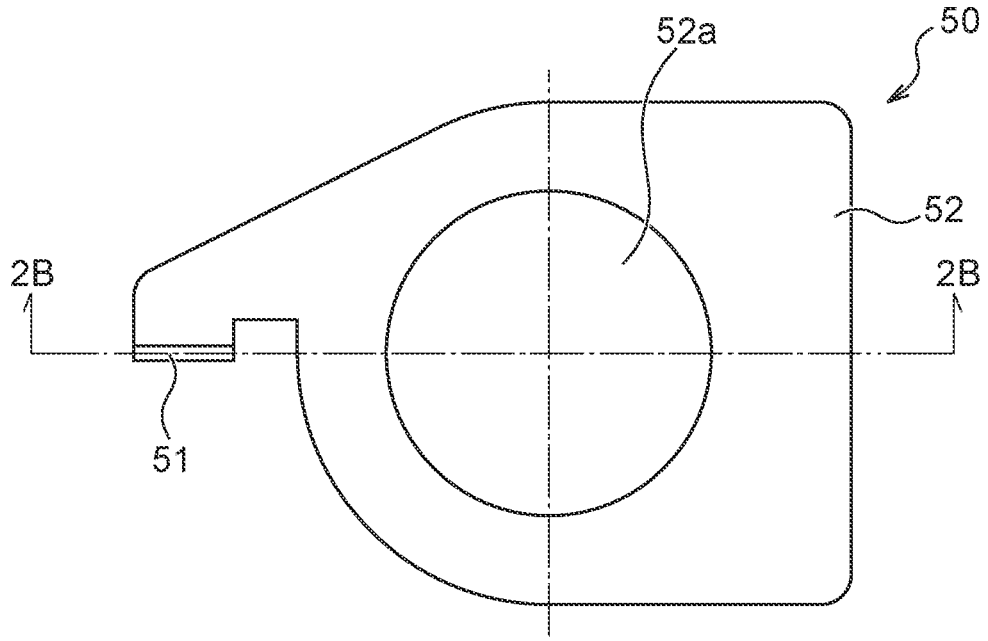
FIG. 2A shows a plan view of a rotary baffle plate shown in FIG. 1.
Figure 2B:
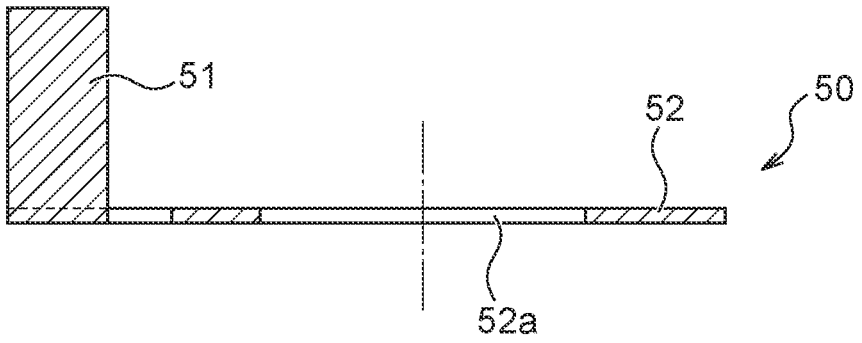
FIG. 2B shows a cross-sectional view of the rotary baffle plate in cross section 2B-2B shown in FIG. 2A.

Therefore, the pump 10 of the present embodiment includes a rotary baffle plate 50 located between the impeller 33 and the mechanical seal 38 and attached to a rotating body of the pump 10. FIG. 2A shows a plan view of the rotary baffle plate 50 shown in FIG. 1. FIG. 2B shows a cross-sectional view of the rotary baffle plate 50 in cross section 2B-2B shown in FIG. 2A. As shown in FIGS. 2A and 2B, the rotary baffle plate 50 includes a baffle plate part 51 and a main body part 52. As shown in FIG. 1, the main body part 52 of the rotary baffle plate 50 is attached to the rotary shaft 31 and rotates with the rotary shaft 31. In the illustrated embodiment, the baffle plate part 51 is provided on the main body part 52 and located between the impeller 33 and the mechanical seal 38. More specifically, the baffle plate part 51 is provided on the main body part 52 to extend from the main body part 52 toward the mechanical seal 38 side. Further, the baffle plate part 51 is disposed inside the mechanical chamber 36*b*.

In the illustrated example, the main body part 52 is a substantially plate-shaped body. However, this shape is not limited, and any shape such as a cylindrical shape can be adopted if the baffle plate part 51 can be attached. The rotary baffle plate 50 can be manufactured by perpendicularly bending a part of a single metal plate of, for example, SUS or the like. Alternatively, the rotary baffle plate 50 may be manufactured by welding the baffle plate part 51 to the main body part 52.

As shown in FIG. 1, the baffle plate part 51 extends in a direction that is inclined or orthogonal with respect to a surface orthogonal to an axial direction of the rotary shaft 31. In other words, the baffle plate part 51 extends from the main body part 52 to have an angle with respect to the plate-shaped main body part 52. Preferably, as shown in FIG. 1, the baffle plate part 51 extends in the direction orthogonal to the surface orthogonal to the axial direction of the rotary shaft 31, that is, in parallel with the axial direction of the rotary shaft 31. More preferably, as shown in FIGS. 1, 2A and 2B, the baffle plate part 51 is oriented so that a main surface of the baffle plate part 51 is parallel to the axial direction of the rotary shaft 31 and so that a central axis of the rotary shaft 31 is included in the same plane as the main surface of the baffle plate part 51. The baffle plate part 51 can have a length, width, shape, and the like arbitrarily adjusted depending on a shape of the mechanical chamber 36*b*. In principle, the larger an area of the baffle plate part 51 is, the more an effect of discharging air from the mechanical chamber 36*b* can improve. In the present description, "the main surface of the baffle plate part 51" refers to a surface that receives the most resistance from water when the baffle plate part 51 rotates with the rotary shaft 31.

As shown in FIG. 2A, the main body part 52 has an opening 52*a* through which the small diameter portion 31*b* of the rotary shaft 31 passes. As shown in FIG. 1, the main body part 52 is sandwiched between the large diameter portion 31*a* of the rotary shaft 31 and the impeller 33. Thus, the main body part 52 frictionally engages with the large diameter portion 31*a* and the impeller 33, and the rotary baffle plate 50 can rotate with the rotation of the rotary shaft 31. In this case, the main body part 52 can be attached to the rotary shaft 31 without requiring any special parts, structures or the like. Not limited to this, the rotary baffle plate 50 can be fixed to the rotary shaft 31 by any engaging method, for example, key engagement or the like.

Further, it is preferable that the rotary baffle plate 50 has a center of gravity that is present on the central axis of the rotary shaft 31. This can suppress occurrence of vibration on the rotary shaft 31 when the rotary baffle plate 50 rotates with the rotary shaft 31.

As described above, the pump 10 of the present embodiment includes the baffle plate part 51 located between the impeller 33 and the mechanical seal 38 and attached to the rotating body (main body part 52). Thus, the baffle plate part 51 rotates with the rotary shaft 31 and can mix water and air between the impeller 33 and the mechanical seal 38, that is, around the mechanical seal 38 and efficiently discharge air with water from the pump 10. Further, since the pump 10 includes the baffle plate part 51, it is possible to easily mix water and air around the mechanical seal 38 and to discharge air from the pump 10, even when the pump 10 is operated at the relatively low rotation speed. When the pump 10 is operated at a normal rotation speed or the relatively high rotation speed, air can be discharged from the pump 10 more efficiently.

Further, in the pump 10 of the present embodiment, it is not necessary to process the casing 35 or the impeller 33, for example, by making a hole. Therefore, a decrease in pump efficiency due to this processing can be prevented, and cost required for the processing can be unnecessary.

Also, in the pump 10 of the present embodiment, the baffle plate part 51 is provided on the main body part 52 to extend from the main body part 52 toward the mechanical seal 38 side. Thereby, the baffle plate part 51 can mix water and air around the mechanical seal 38, and efficiently discharge air with water from the pump 10.

Figure 3A:
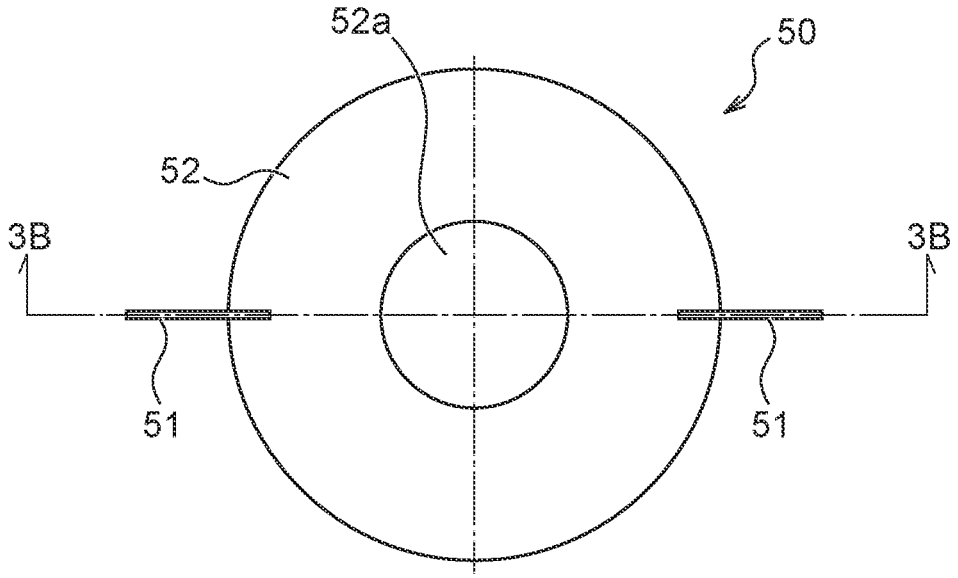
FIG. 3A shows a plan view of another example of the rotary baffle plate.
Figure 3B:
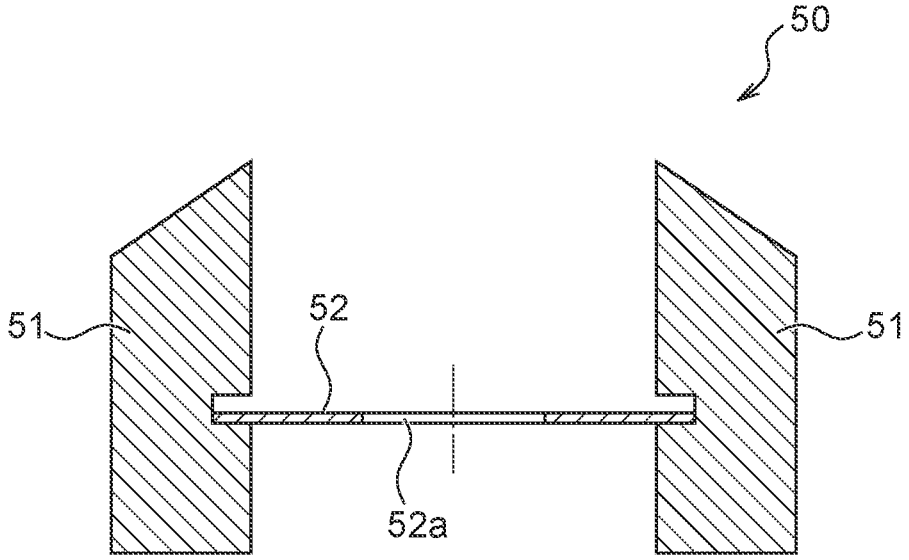
FIG. 3B shows a cross-sectional view of the rotary baffle plate in cross section 3B-3B shown in FIG. 3A.

Next, other examples of the rotary baffle plate 50 will be described. FIG. 3A shows a plan view of another example of the rotary baffle plate 50. FIG. 3B shows a cross-sectional view of the rotary baffle plate 50 in cross section 3B-3B shown in FIG. 3A. In the rotary baffle plate 50 shown in FIG. 3A, the main body part 52 has a doughnut-shaped disc shape. The rotary baffle plate 50 also includes two baffle plate parts 51. As shown in FIGS. 2A and 2B, the baffle plate part 51 extends above and below the main body part 52 in parallel with the axial direction of the rotary shaft 31 and is oriented so that the central axis of the rotary shaft 31 is included in the same plane as the main surface of the baffle plate part 51. The baffle plate part 51 can be joined to the main body part 52, for example, by welding. Thus, the rotary baffle plate 50 according to the present embodiment may comprise a plurality of baffle plate parts 51.

Figure 4A:
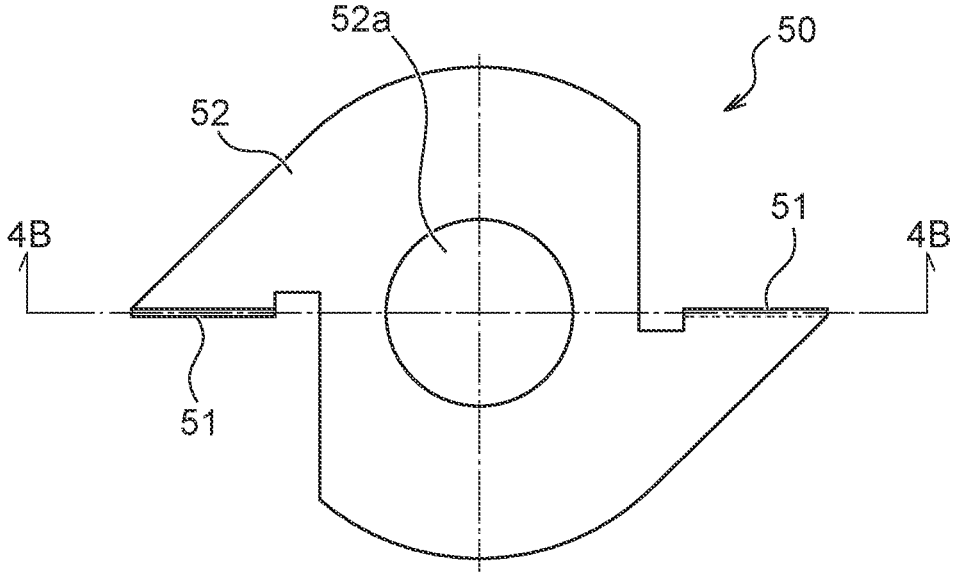
FIG. 4A shows a plan view of still another example of the rotary baffle plate.
Figure 4B:
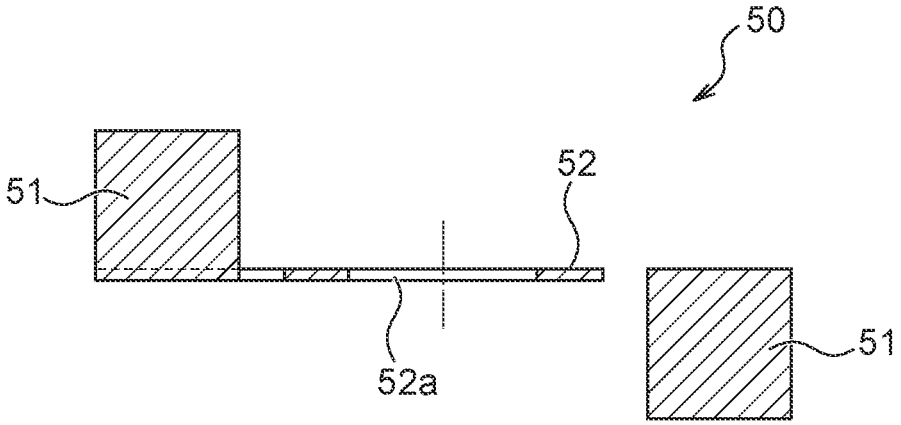
FIG. 4B shows a cross-sectional view of the rotary baffle plate in cross section 4B-4B shown in FIG. 4A.

FIG. 4A shows a plan view of another example of the rotary baffle plate 50. FIG. 4B shows a cross-sectional view of the rotary baffle plate 50 in cross section 4B-4B shown in FIG. 4A. The rotary baffle plate 50 shown in FIG. 4A includes a plate-shaped main body part 52 in the same manner as the rotary baffle plate 50 shown in FIGS. 2A and 2B and FIGS. 3A and 3B. Further, the rotary baffle plate 50 includes two identically shaped baffle plate parts 51. As shown in FIG. 4B, one baffle plate part 51 is configured to extend in one way of (e.g., above) the main body part 52, and the other baffle plate part 51 is configured to extend in another way (e.g., below). Both baffle plate parts 51 extend in parallel with the axial direction of the rotary shaft 31 and are oriented so that the central axis of the rotary shaft 31 is included in the same plane as the main surface of the baffle plate part 51. The rotary baffle plate 50 can be manufactured by perpendicularly bending a part of a single metal plate of, for example, SUS or the like. Alternatively, the rotary baffle plate 50 may be manufactured by welding the baffle plate parts 51 to the main body part 52. Thus, the rotary baffle plate 50 may be configured so that a plurality of baffle plate parts 51 having the same shape extend in respective opposite directions. Thereby, orientation in which the rotary baffle plate 50 is attached to the rotary shaft 31 is not limited, and hence human error when attaching the rotary baffle plate 50 to the rotary shaft 31 can be prevented.

Figure 5A:
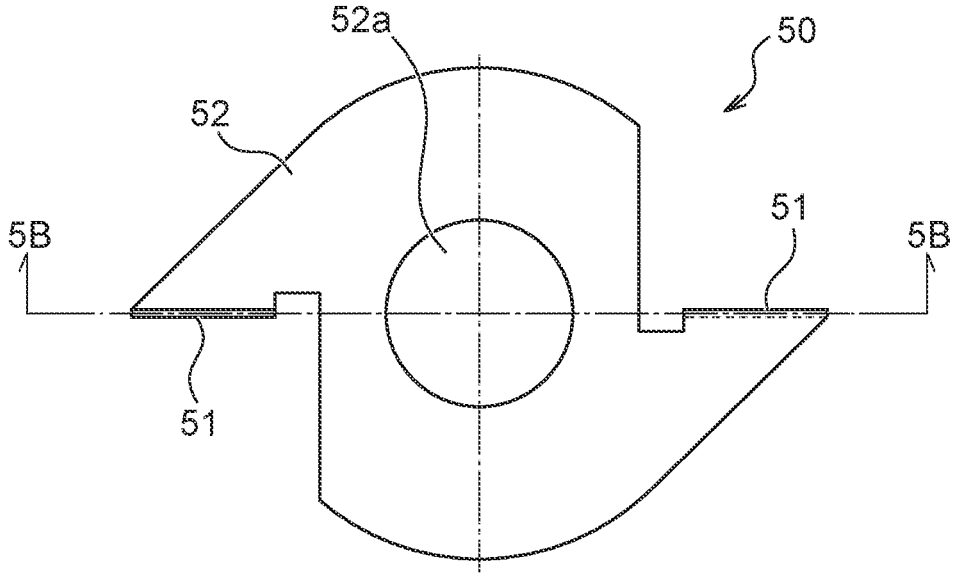
FIG. 5A shows a plan view of a further example of the rotary baffle plate.
Figure 5B:
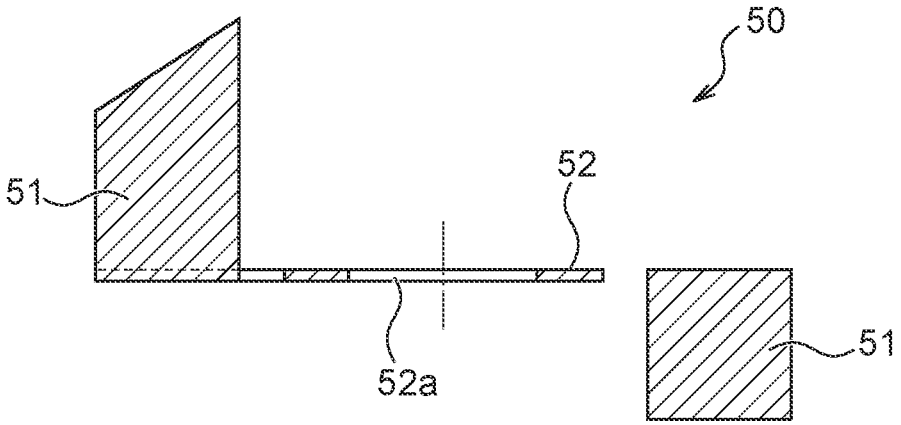
FIG. 5B shows a cross-sectional view of the rotary baffle plate in cross section 5B-5B shown in FIG. 5A.

FIG. 5A shows a plan view of another example of the rotary baffle plate 50. FIG. 5B shows a cross-sectional view of the rotary baffle plate 50 in cross section 5B-5B shown in FIG. 5A. The rotary baffle plate 50 shown in FIG. 5A includes a plate-shaped main body part 52 in the same manner as the rotary baffle plate 50 shown in FIGS. 4A and 4B. Further, this rotary baffle plate 50 includes two baffle plate parts 51 having different shapes. As shown in FIG. 5B, one baffle plate part 51 is configured to extend in one way of (e.g., above) the main body part 52, and the other baffle plate part 51 is configured to extend in another way (e.g., below). Both baffle plate parts 51 extend in parallel with the axial direction of the rotary shaft 31 and are oriented so that the central axis of the rotary shaft 31 is included in the same plane as the main surface of the baffle plate part 51. The rotary baffle plate 50 can be manufactured by perpendicularly bending a part of a single metal plate of, for example, SUS or the like. Alternatively, the rotary baffle plate 50 may be manufactured by welding the baffle plate parts 51 to the main body part 52. Thus, the rotary baffle plate 50 may be configured so that a plurality of baffle plate parts 51 having different shapes extend in respective opposite directions. Thereby, orientation in which the rotary baffle plate 50 is attached to the rotary shaft 31 is not limited, and hence human error when attaching the rotary baffle plate 50 to the rotary shaft 31 can be prevented.

Figure 6A:
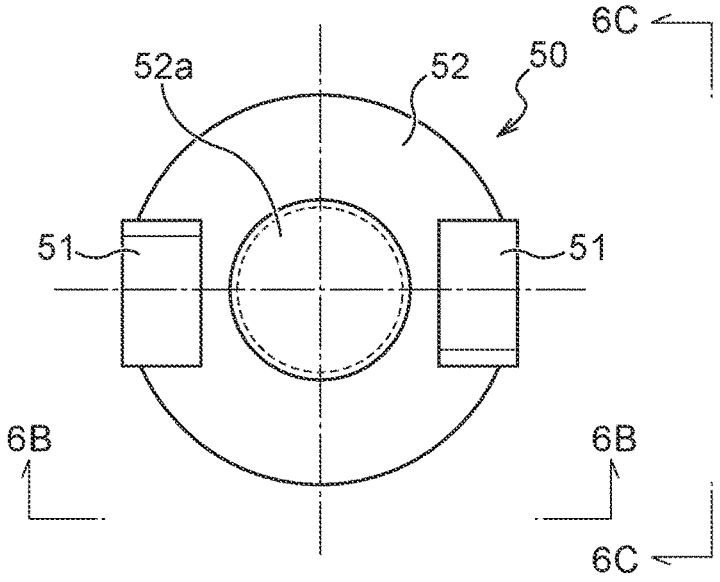
FIG. 6A shows a plan view of a further example of the rotary baffle plate.
Figure 6B:
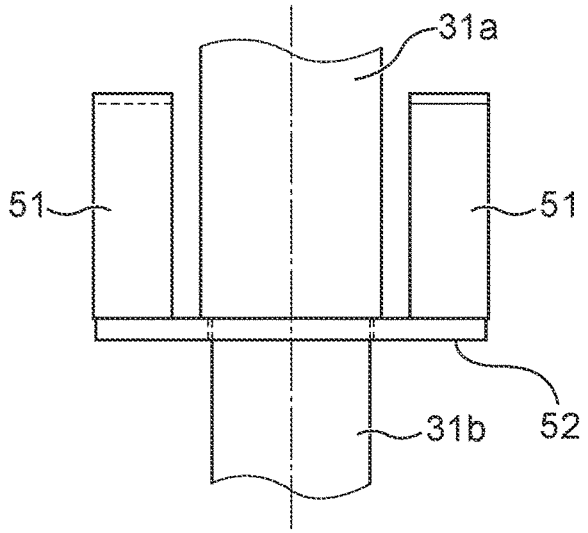
FIG. 6B shows a side view seen from arrow 6B-6B shown in FIG. 6A.
Figure 6C:
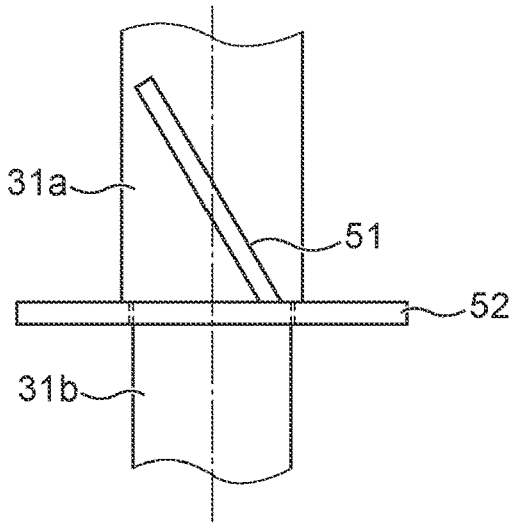
FIG. 6C shows a side view seen from arrow 6C-6C shown in FIG. 6A.

FIG. 6A shows a plan view of another example of the rotary baffle plate 50. FIG. 6B shows a side view seen from arrow 6B-6B shown in FIG. 6A. FIG. 6C shows a side view seen from arrow 6C-6C shown in FIG. 6A. FIGS. 6B and 6C show the rotary shaft 31 for the convenience of explanation. The rotary baffle plate 50 shown in FIGS. 6A to 6C includes a main body part 52 having a doughnut-shaped disc shape in the same manner as in the rotary baffle plate 50 shown in FIGS. 3A and 3B. Further, the rotary baffle plate 50 includes a pair of baffle plate parts 51 extending in a direction that is inclined with respect to a surface orthogonal to the axial direction of the rotary shaft 31. Specifically, in the illustrated example, the pair of baffle plate parts 51 extend upward from the main body part 52 (on a mechanical seal 38 side) to be inclined at the same angle in directions opposite to each other. The pair of baffle plate parts 51 may extend to be inclined in the same direction or to be inclined at angles different from each other. The rotary baffle plate 50 may be manufactured by welding the baffle plate parts 51 to the main body part 52. Thus, in the rotary baffle plate 50, the baffle plate parts 51 may extend to be inclined with respect to the surface orthogonal to the axial direction of the rotary shaft 31.

Figure 7A:
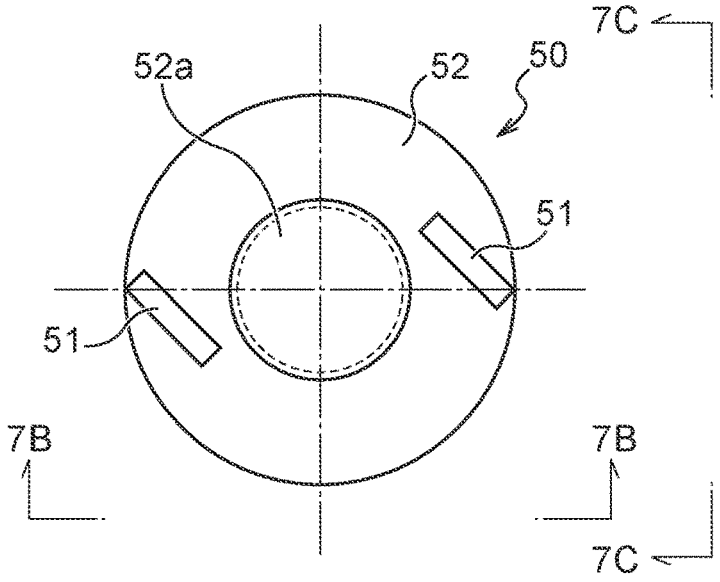
FIG. 7A shows a plan view of a further example of the rotary baffle plate.
Figure 7B:
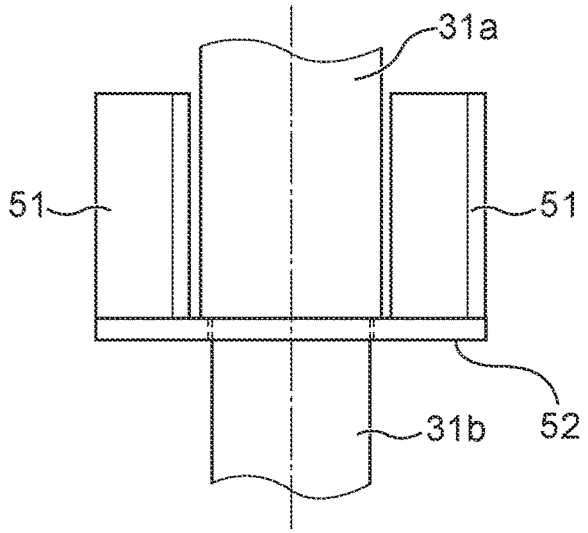
FIG. 7B shows a side view seen from arrow 7B-7B shown in FIG. 7A.
Figure 7C:
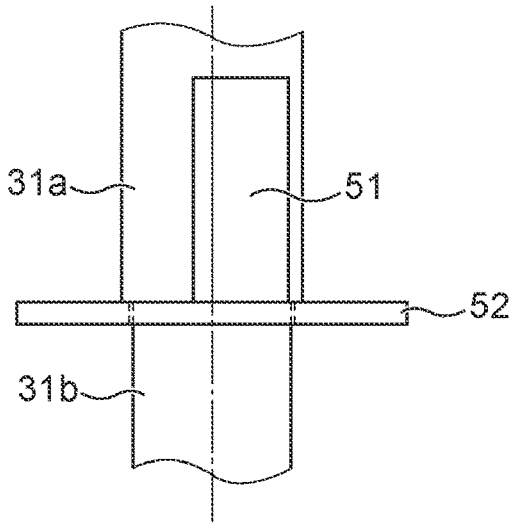
FIG. 7C shows a side view seen from arrow 7C-7C shown in FIG. 7A.

FIG. 7A shows a plan view of another example of the rotary baffle plate 50. FIG. 7B shows a side view seen from arrow 7B-7B shown in FIG. 7A. FIG. 7C shows a side view seen from arrow 7C-7C shown in FIG. 7A. FIGS. 7B and 7C show the rotary shaft 31 for the convenience of explanation. The rotary baffle plate 50 shown in FIGS. 7A to 7C includes a main body part 52 having a doughnut-shaped disc shape in the same manner as the rotary baffle plate 50 shown in FIGS. 3A and 3B. Further, the rotary baffle plate 50 includes a pair of baffle plate parts 51 extending in a direction orthogonal to a surface orthogonal to the axial direction of the rotary shaft 31, that is, in parallel with the rotary shaft 31. In the illustrated example, the pair of baffle plate parts 51 have a main surface parallel to the axial direction of the rotary shaft 31, but the baffle plate parts 51 are oriented so that the central axis of the rotary shaft 31 is not included in the same plane as the main surface. In the illustrated example, the main surfaces of the pair of baffle plate parts 51 are parallel to each other but are not limited. The rotary baffle plate 50 may be manufactured by welding the baffle plate parts 51 to the main body part 52. Thus, the rotary baffle plate 50 may be configured so that the central axis of the rotary shaft 31 is not included in the same plane as the main surface of the baffle plate part 51.

Figure 8A:
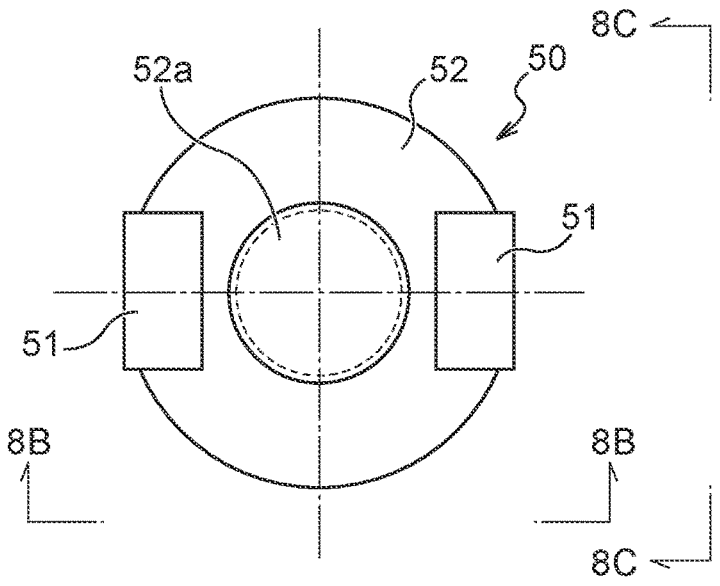
FIG. 8A shows a plan view of a further example of the rotary baffle plate.
Figure 8B:
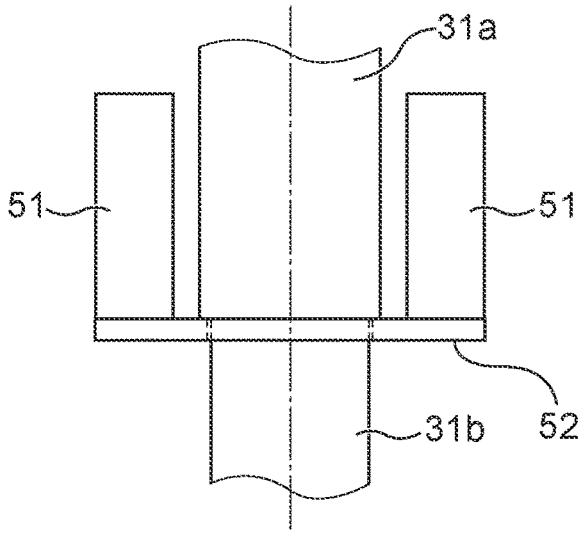
FIG. 8B shows a side view seen from arrow 8B-8B shown in FIG. 8A.
Figure 8C:
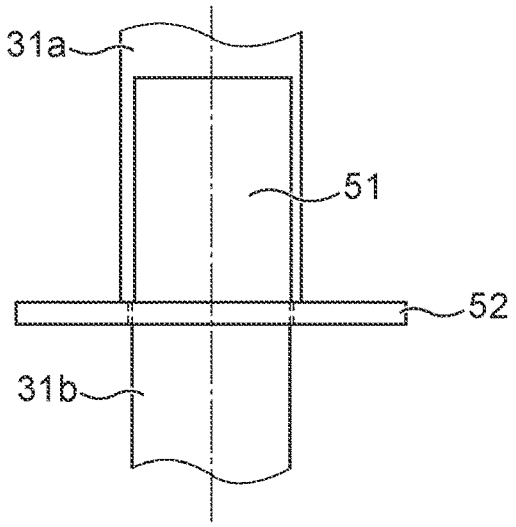
FIG. 8C shows a side view seen from arrow 8C-8C shown in FIG. 8A.

FIG. 8A shows a plan view of another example of the rotary baffle plate 50. FIG. 8B shows a side view seen from arrow 8B-8B shown in FIG. 8A. FIG. 8C shows a side view seen from arrow 8C-8C shown in FIG. 8A. FIGS. 8B and 8C show the rotary shaft 31 for the convenience of explanation. The rotary baffle plate 50 shown in FIGS. 8A to 8C includes a main body part 52 having a doughnut-shaped disc shape in the same manner as the rotary baffle plate 50 shown in FIGS. 3A and 3B. Further, the rotary baffle plate 50 includes a pair of baffle plate parts 51 extending in a direction orthogonal to a surface orthogonal to the axial direction of the rotary shaft 31, that is, in parallel with the rotary shaft 31. In the illustrated example, a pair of baffle plate parts 51 have a larger thickness than the baffle plate part 51 shown in FIGS. 2 to 7. Each baffle plate part 51 in the illustrated example has a main surface that is a side surface of the baffle plate part 51 seen from a direction shown in FIG. 8B. Therefore, in the illustrated example, the main surface of the baffle plate part 51 extends in parallel with the axial direction of the rotary shaft 31. On the other hand, the baffle plate part 51 is oriented so that the central axis of the rotary shaft 31 is not included in the same plane as the main surface of the baffle plate part. Thus, "the baffle plate part 51" in the present description includes not only a thin plate-shaped body but also a columnar body.

Figure 9A:
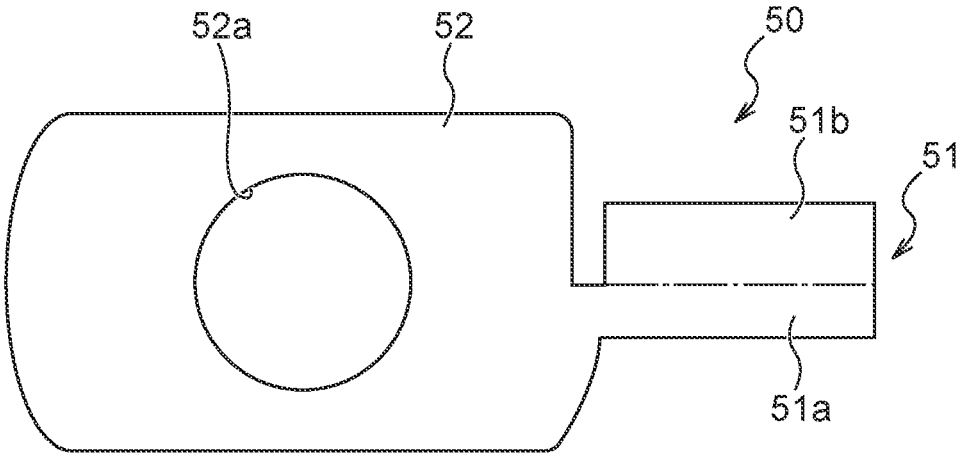
FIG. 9A shows a plan view of a material of a still further example of the rotary baffle plate.
Figure 9B:
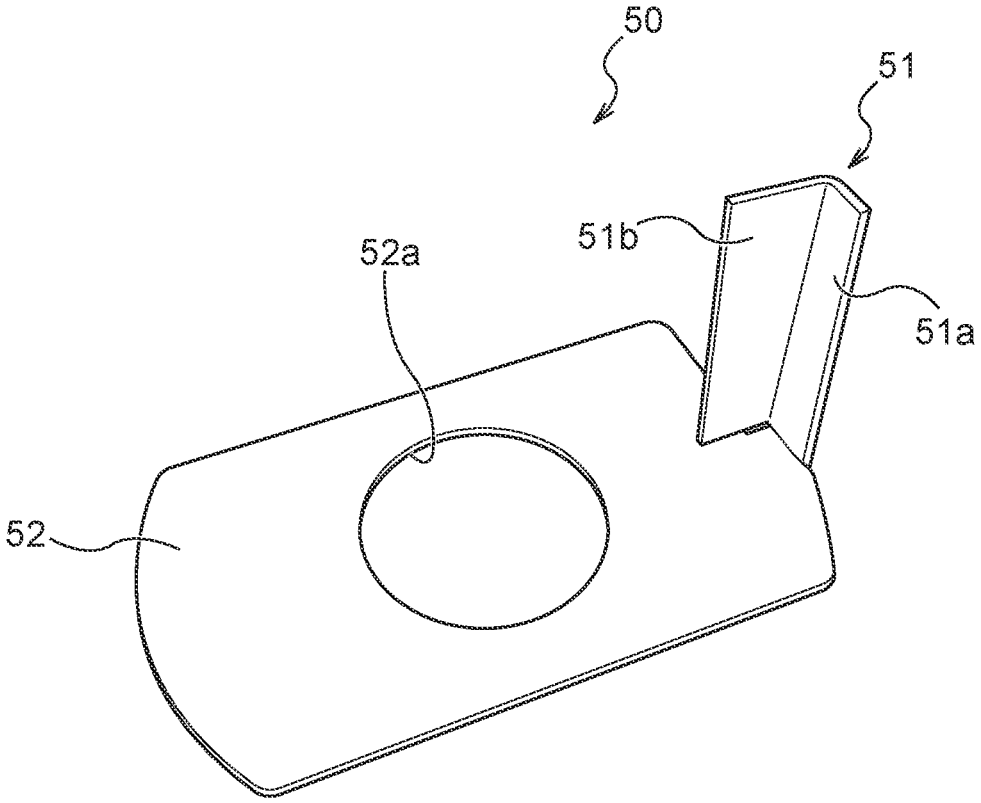
FIG. 9B shows a perspective view of the rotary baffle plate formed of the material shown in FIG. 9A.

FIG. 9A shows a plan view of a material of another example of the rotary baffle plate 50. FIG. 9B shows a perspective view of the rotary baffle plate 50 formed of the material shown in FIG. 9A. As shown in FIG. 9A, the material of the rotary baffle plate 50 is a single metal plate of, for example, SUS or the like, and includes a main body part 52 and a baffle plate part 51. The baffle plate part 51 includes a main surface portion 51*b* that receives the most resistance from water when the baffle plate part 51 rotates with the rotary shaft 31, and a coupling portion 51*a* coupling the main surface portion 51*b* and the main body part 52.

The rotary baffle plate 50 shown in FIG. 9B is formed by bending the coupling portion 51*a* of the material shown in FIG. 9A at right angles to the main body part 52 and bending the main surface portion 51*b* at right angles to the coupling portion 51*a*. In the rotary baffle plate 50 shown in FIG. 9B, the baffle plate part 51 is oriented so that a main surface of the main surface portion 51*b* of the baffle plate part 51 is parallel to the axial direction of the rotary shaft 31 and the central axis of the rotary shaft 31 is included in the same plane as the main surface. Thus, since the rotary baffle plate 50 can be formed by bending the plate material twice, processing such as welding is unnecessary, and production cost can be reduced though increasing strength.

Figure 10:
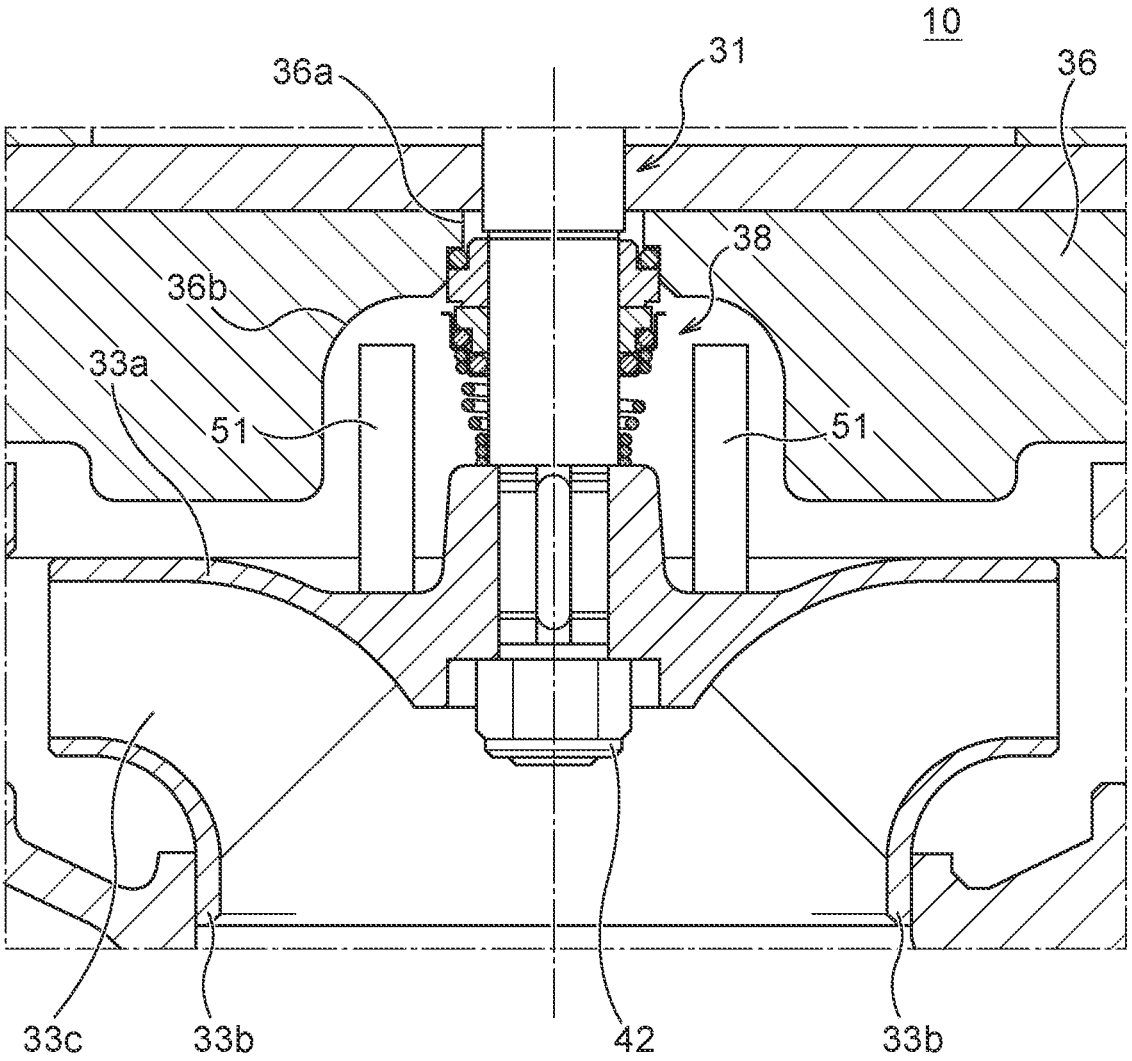
FIG. 10 is an enlarged cross-sectional view of a pump according to another embodiment.

Next, a pump 10 according to another embodiment will be described. FIG. 10 is an enlarged cross-sectional view of the pump 10 according to the embodiment. FIG. 10 shows the vicinity of an impeller 33 and a mechanical seal 38 in an enlarged manner. A part that is not shown in FIG. 10 may have a structure like the pump 10 shown in FIG. 1. The pump 10 shown in FIG. 10 does not include a rotary baffle plate 50 compared to the pump 10 shown in FIG. 1. Instead, the pump 10 shown in FIG. 10 includes a baffle plate part 51 attached to a main plate 33*a* of the impeller 33.

The baffle plate part 51 shown in FIG. 10 is located between the impeller 33 and the mechanical seal 38 and is attached to the impeller 33 that is a rotating body, for example, by welding or the like. As shown in FIG. 10, the baffle plate part 51 extends in a direction that is inclined or orthogonal with respect to a surface orthogonal to an axial direction of a rotary shaft 31. Preferably, as shown in FIG. 10, the baffle plate part 51 extends in a direction orthogonal to a surface orthogonal to the axial direction of the rotary shaft 31, that is, in parallel with the axial direction of the rotary shaft 31. More preferably, as shown in FIG. 10, the baffle plate part is oriented so that a main surface of the baffle plate part 51 is parallel to the axial direction of the rotary shaft 31 and so that a central axis of the rotary shaft 31 is included in the same plane as the main surface of the baffle plate part 51. Thereby, the baffle plate part 51 can efficiently stir water.

According to the pump 10 shown in FIG. 10, the baffle plate part 51 rotates with the rotary shaft 31 and can mix water and air inside a mechanical chamber 36*b*, that is, around the mechanical seal 38, and efficiently discharge air with water from the pump 10. Further, since the pump 10 includes the baffle plate part 51, it is possible to easily mix water and air around the mechanical seal 38, and to discharge air from the pump 10, even when the pump 10 is operated at a relatively low rotation speed. When the pump 10 is operated at a normal rotation speed or a relatively high rotation speed, air can be discharged from the pump 10 more efficiently.

Further, in the pump 10 of the present embodiment, although processing of attaching the baffle plate part 51 to the existing impeller 33 is required, there is an advantage that another part such as the rotary baffle plate 50 does not need to be prepared separately.

Figure 11:
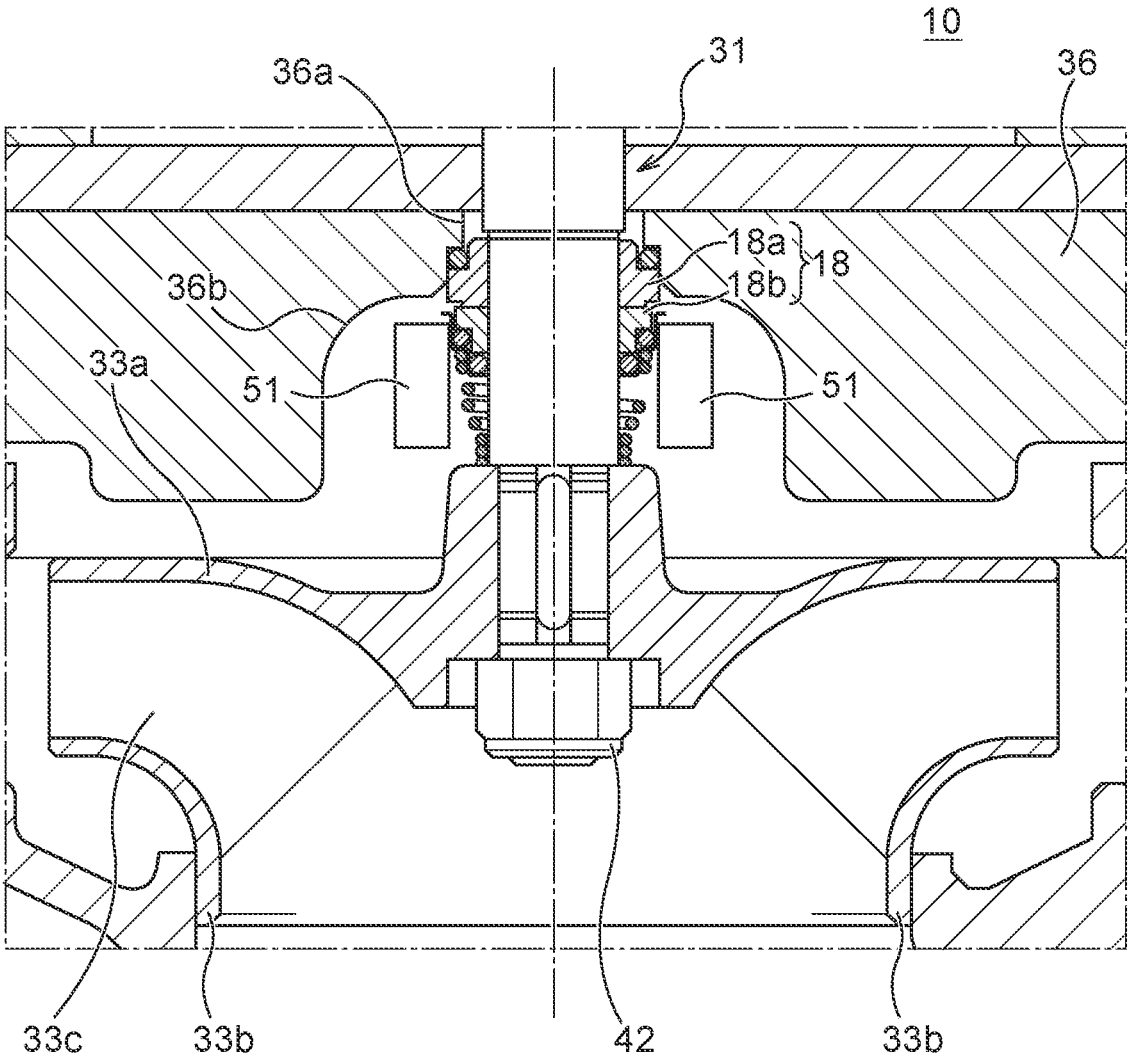
FIG. 11 is an enlarged cross-sectional view of a pump according to still another embodiment.

FIG. 11 is an enlarged cross-sectional view of a pump 10 according to another embodiment. FIG. 11 shows the vicinity of an impeller 33 and a mechanical seal 38 in an enlarged manner. A part that is not shown in FIG. 11 may have a structure like the pump 10 shown in FIG. 1. The pump 10 shown in FIG. 11 does not include a rotary baffle plate 50 compared to the pump 10 shown in FIG. 1. Instead, the pump 10 shown in FIG. 11 includes a baffle plate part 51 attached to the mechanical seal 38.

The mechanical seal 38 includes a fixed ring 38*a* fixed to an upper casing 36 and a rotating ring 38*b* rotating with a rotary shaft 31. A baffle plate part 51 shown in FIG. 11 is located between the impeller 33 and the mechanical seal 38 and is attached to the rotating ring 38*b* that is a rotating body, for example, by welding or the like. As shown in FIG. 11, the baffle plate part 51 extends in a direction that is inclined or orthogonal with respect to a surface orthogonal to an axis direction of the rotary shaft 31. Preferably, as shown in FIG. 11, the baffle plate part 51 extends in a direction orthogonal to the surface orthogonal to the axial direction of the rotary shaft 31, that is, in parallel with the axial direction of the rotary shaft 31. More preferably, as shown in FIG. 11, the baffle plate part 51 is oriented so that a main surface of the baffle plate part 51 is parallel to the axial direction of the rotary shaft 31 and so that a central axis of the rotary shaft 31 is included in the same plane as the main surface of the baffle plate part 51.

According to the pump 10 shown in FIG. 11, the baffle plate part 51 rotates with the rotary shaft 31 and can mix water and air inside a mechanical chamber 36*b*, that is, around the mechanical seal 38, and efficiently discharge air with water from the pump 10. Further, since the pump 10 includes the baffle plate part 51, it is possible to easily mix water and air around the mechanical seal 38, and to discharge air from the pump 10, even when the pump 10 is operated at a relatively low rotation speed. When the pump 10 is operated at a normal rotation speed or a relatively high rotation speed, air can be discharged from the pump 10 more efficiently.

Further, in the pump 10 of the present embodiment, although processing of attaching the baffle plate part 51 to the existing mechanical seal 38 is required, there is an advantage that another part such as the rotary baffle plate 50 does not need to be prepared separately.

Figure 12A:
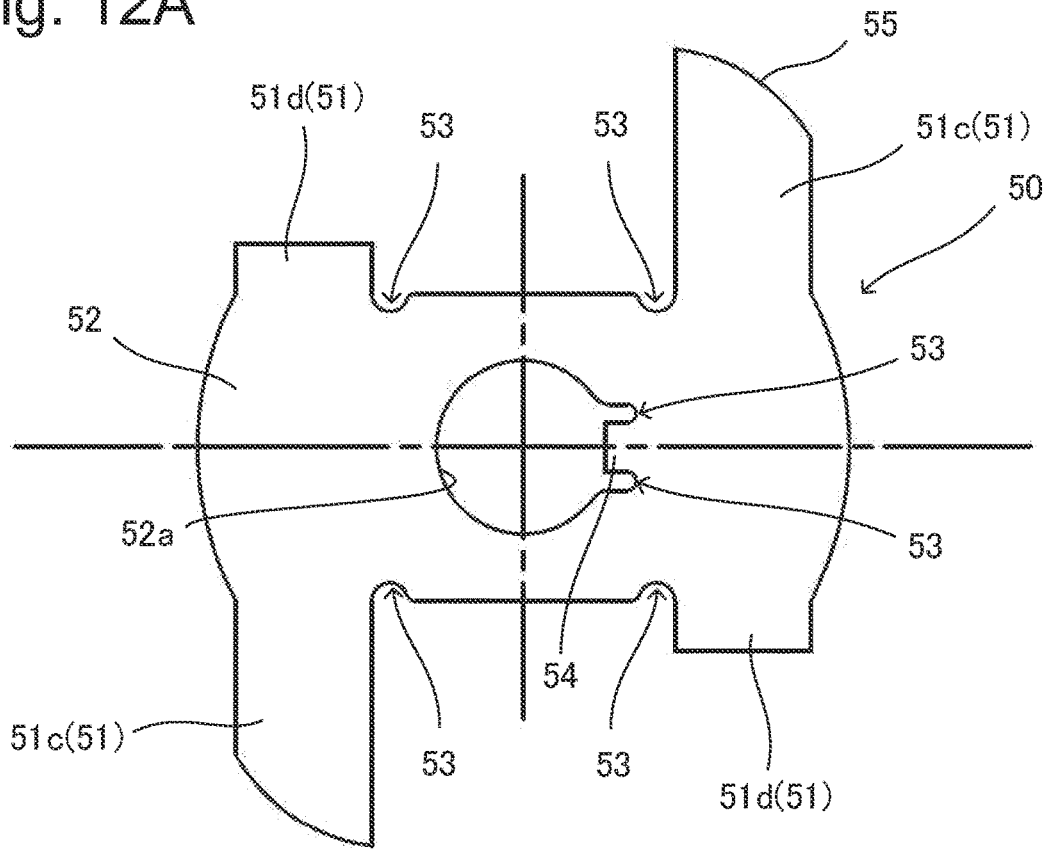
FIG. 12A shows a plan view of a material of another example of the rotary baffle plate.
Figure 12B:
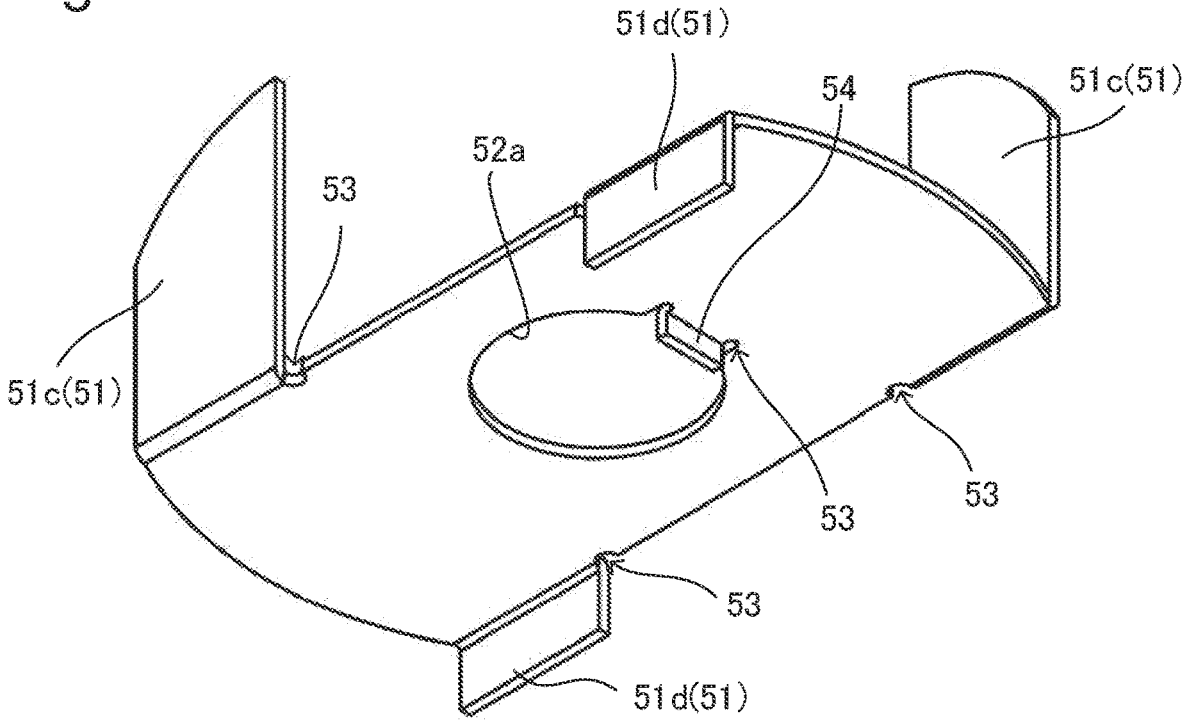
FIG. 12B shows a perspective view of the rotary baffle plate formed of the material shown in FIG. 12A.

FIG. 12A shows a plan view of a material of another example of the rotary baffle plate 50. FIG. 12B shows a perspective view of the rotary baffle plate 50 formed of the material shown in FIG. 12A. As shown in FIG. 12A, the material of the rotary baffle plate 50 is a single metal plate of, for example, SUS or the like, and includes a main body part 52 and a baffle plate part 51. The baffle plate part 51 includes an upper baffle plate portion 51*c* and a lower baffle plate portion 51*d*. In the illustrated example, the baffle plate part includes two upper baffle plate portions 51*c* and two lower baffle plate portions 51*d*, but is not limited, and the baffle plate part 51 may include at least one upper baffle plate portion 51*c* and at least one lower baffle plate portion 51*d*.

As shown in FIGS. 12A and 12B, each lower baffle plate portion 51*d* is a substantially rectangular plate-shaped body shorter than the upper baffle plate portion 51*c*. The upper baffle plate portion 51*c* has a shape in which one corner of the rectangular plate-shaped body is chamfered. Specifically, in the upper baffle plate portion 51*c*, a corner on a side away from an opening 52*a*, through which a rotary shaft 31 passes, is chamfered in an arc shape with a width gradually decreasing toward a tip. That is, the upper baffle plate portion 51*c* may have an arc-shaped tip surface 55 in a plane shown in FIG. 12A. As shown in FIG. 12B, the upper baffle plate portion 51*c* extends upward in parallel with an axial direction of the rotary shaft 31 when the rotary baffle plate 50 is attached to the rotary shaft 31. The lower baffle plate portion 51*d* extends downward in parallel with the axial direction of the rotary shaft 31 when the rotary baffle plate 50 is attached to the rotary shaft 31.

The rotary baffle plate 50 also includes a fixing part 54. The fixing part 54 may be a plate-shaped body extending substantially at right angles to the main body part 52. The fixing part 54 is located adjacent to the opening 52*a* and engages in a keyway of an impeller 33 and/or a keyhole of the rotary shaft 31 so that the main body part 52 does not move in a circumferential direction with respect to the rotary shaft 31 or the impeller 33 when the rotary baffle plate 50 is attached to the rotary shaft 31. Since the rotary baffle plate 50 includes the fixing part 54, the rotary baffle plate 50 can be securely fixed so as not to move in the circumferential direction with respect to the rotary shaft 31 or the impeller 33.

In order to form the rotary baffle plate 50 shown in FIG. 12B, the upper baffle plate portions 51*c*, the lower baffle plate portions 51*d* and the fixing part 54 shown in FIG. 12 are bent substantially at right angles to the main body part 52. Specifically, the upper baffle plate portions 51*c* are bent substantially at right angles to the main body part 52, and the lower baffle plate portions 51*d* and the fixing part 54 are bent substantially at right angles in a direction opposite to a bending direction of the upper baffle plate portions 51*c*.

Further, as shown in FIGS. 12A and 12B, when the baffle plate part 51 is bent and formed, the main body part 52 preferably includes a curved relief portion 53 near a base of the baffle plate part 51. The curved relief portion 53 may be a cutout formed in the main body part 52. The main body part 52 includes the curved relief portion 53, and hence even if the baffle plate part 51 is bent at right angles to the main body part 52, stress is inhibited from being concentrated on the base of the baffle plate part 51 during operation of the pump 10. As a result, the baffle plate part 51 can be prevented from being broken early. Further, in the illustrated example, since the fixing part 54 is also bent and formed, it is preferable that the main body part 52 includes the curved relief portion 53 near the base of the fixing part 54.

Figure 13A:
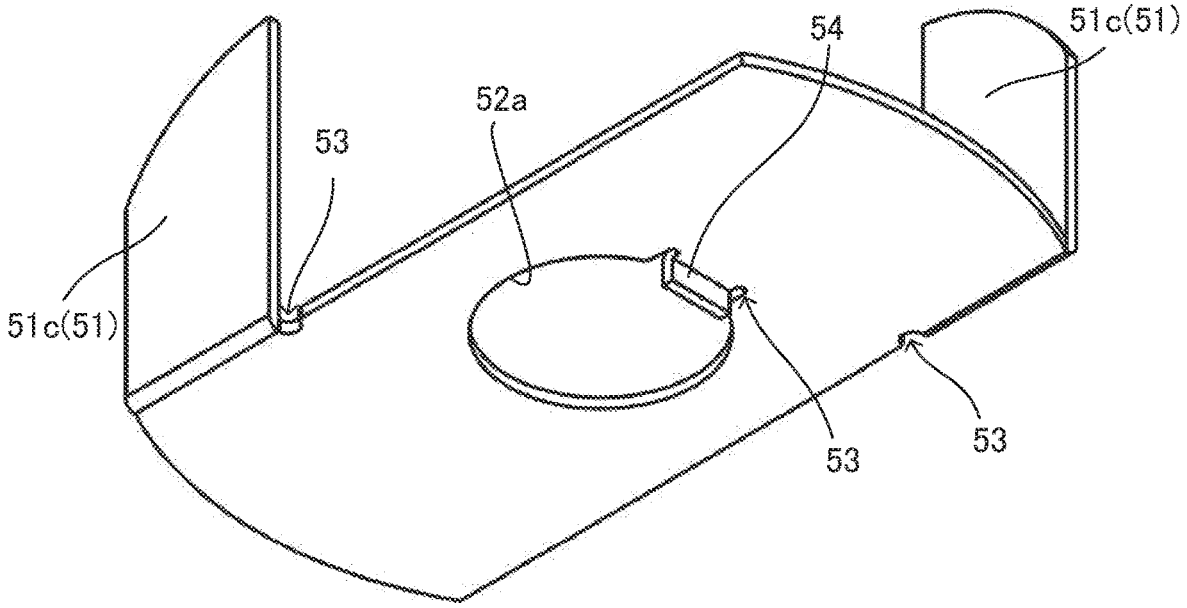
FIG. 13A shows a perspective view of still another example of the rotary baffle plate.
Figure 13B:
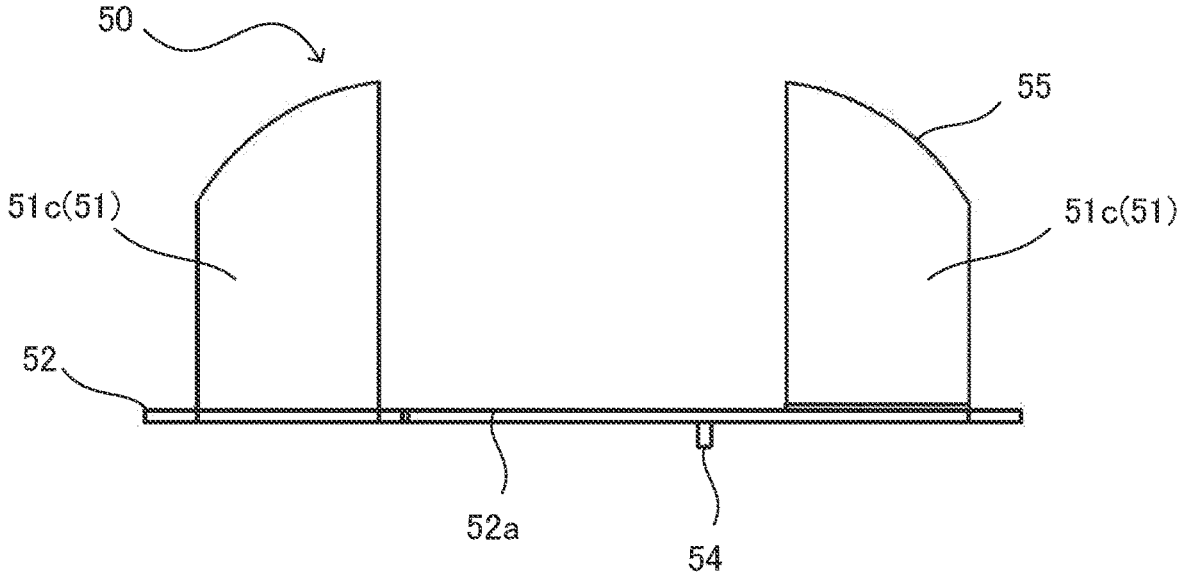
FIG. 13B shows a side view of the rotary baffle plate shown in FIG. 13A.

FIG. 13A is a perspective view of another example of the rotary baffle plate 50. FIG. 13B is a side view of the rotary baffle plate 50 shown in FIG. 13A. The rotary baffle plate 50 shown in FIGS. 13A and 13B is different from the rotary baffle plate 50 shown in FIGS. 12A and 12B only in that a lower baffle plate portion 51*d* is not provided. Thus, the lower baffle plate portion 51*d* may be omitted from the rotary baffle plate 50 shown in FIGS. 12A and 12B.

Figure 14:
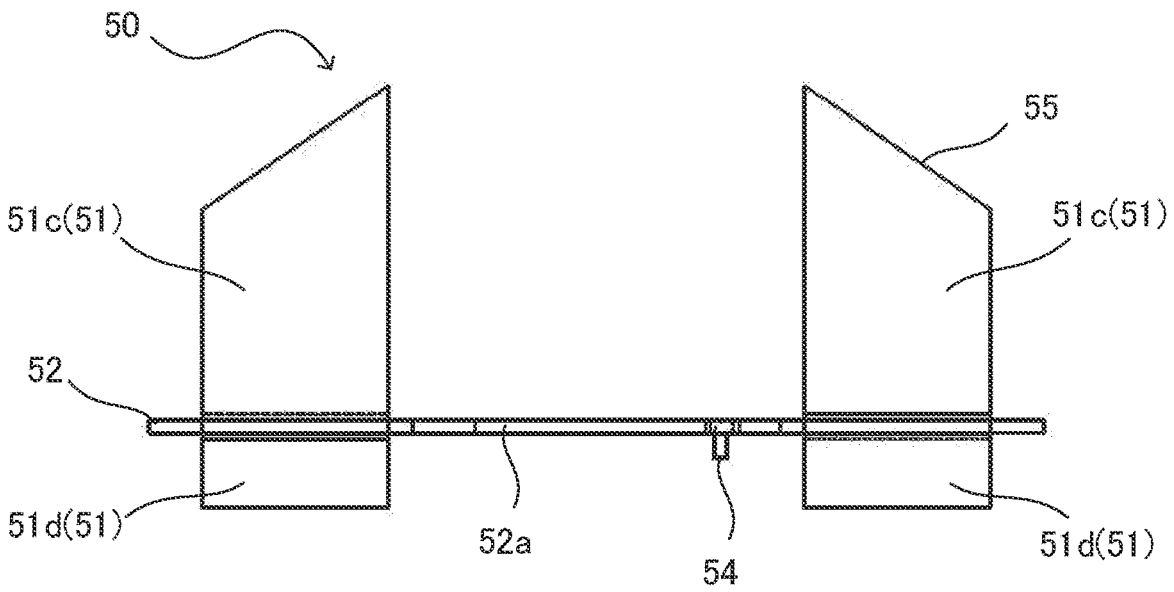
FIG. 14 shows a side view of a further example of the rotary baffle plate.

FIG. 14 shows a side view of another example of the rotary baffle plate 50. The rotary baffle plate 50 shown in FIG. 14 is different from the rotary baffle plate 50 shown in FIGS. 12A and 12B only in a shape of a tip surface 55 of an upper baffle plate portion 51*c*. The upper baffle plate portion 51*c* of the rotary baffle plate 50 shown in FIG. 14 has a shape in which one corner of a rectangular plate-shaped body is chamfered in a square surface shape. Specifically, in the upper baffle plate portion 51*c*, the corner away from an opening 52*a*, through which a rotary shaft 31 passes, is chamfered in the square surface shape with a width gradually decreasing toward a tip. That is, in FIG. 14, the upper baffle plate portion 51*c* includes the linear tip surface 55 inclined with respect to a main surface of a main body part 52.

Figure 15:
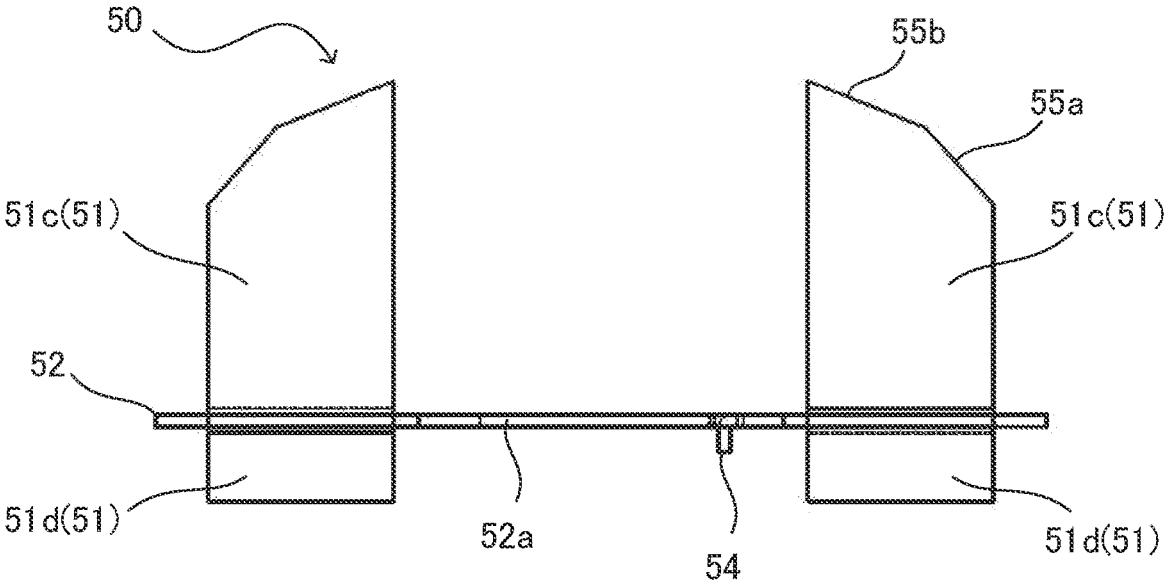
FIG. 15 shows a side view of a still further example of the rotary baffle plate.

FIG. 15 shows a side view of another example of the rotary baffle plate 50. The rotary baffle plate 50 shown in FIG. 15 is different from the rotary baffle plate 50 shown in FIGS. 12A and 12B only in a shape of a tip surface 55 of an upper baffle plate portion 51*c*. The upper baffle plate portion 51*c* of the rotary baffle plate 50 shown in FIG. 15 has a shape in which one corner of a rectangular plate-shaped body is chamfered twice in a square surface shape. Specifically, in the upper baffle plate portion 51*c*, the corner away from an opening 52*a*, through which a rotary shaft 31 passes, is chamfered twice in the square surface shape with a width gradually decreasing toward a tip. That is, in FIG. 14, the upper baffle plate portion 51*c* includes a linear first tip surface 55*a* inclined with respect to a main surface of a main body part 52, and a linear second tip surface 55*b* inclined at an angle different from that of the first tip surface 55*a*.

The embodiments of the present invention have been described above, but the above embodiments of the present invention are described to facilitate understanding of the present invention and are not intended to limit the present invention. The present invention may be changed or modified without departing from the spirit, and the present invention includes equivalents to the embodiment. Also, in a range in which at least some of the above-described problems can be solved or a range in which at least some of effects are exhibited, any combination or omission of respective constituent components described in claims and description is possible.

The present description discloses aspects as follows.

In a first aspect, a pump is provided. This pump includes a rotary shaft, an impeller that is attached to the rotary shaft and that rotates with rotation of the rotary shaft, a casing that surrounds the rotary shaft, a shaft sealing device that seals a gap between the casing and the rotary shaft, and a baffle plate part that is located between the impeller and the shaft sealing device and attached to a rotating body, the baffle plate part extending in a direction that is inclined or orthogonal with respect to a surface orthogonal to an axial direction of the rotary shaft.

According to the first aspect, the baffle plate part rotates with the rotating body, and can therefore mix water and air between the impeller and the shaft sealing device and efficiently discharge air with water from the pump. Therefore, since it is not necessary to process the casing or the impeller, for example, by making a hole or the like, a decrease in pump efficiency due to this processing can be prevented, and cost required for the processing can be unnecessary. Also, since the pump includes the baffle plate part, it is possible to easily mix water and air between the impeller and the shaft sealing device and to discharge air from the pump, even when the pump is operated at a relatively low rotation speed. In addition, when the pump is operated at a normal rotation speed or a relatively high rotation speed, air can be discharged from the pump more efficiently.

A second aspect provides that the pump of the first aspect further includes a rotary baffle plate that is attached to the rotary shaft so as to be located between the impeller and the shaft sealing device, the rotary baffle plate including a main body part attached to the rotary shaft, and the baffle plate part provided on the main body part.

According to the second aspect, air in the pump can be discharged only by attaching the main body part provided with the baffle plate part to the rotary shaft.

A third aspect provides that in the pump of the second aspect, the rotary baffle plate has a center of gravity that is present on a central axis of the rotary shaft.

The third aspect can suppress occurrence of vibration on the rotary shaft when the baffle plate part and main body part rotate with the rotary shaft.

A fourth aspect provides that in the pump of the second or third aspect, the baffle plate part extends from the main body part to a side of the shaft sealing device.

According to the fourth aspect, the baffle plate part can mix water and air around the shaft sealing device and efficiently discharge air with water from the pump.

A fifth aspect provides that in the pump of any of the second to fourth aspects, the rotary shaft includes a large diameter portion, and a small diameter portion located on a tip side of the large diameter portion, and the main body part has an opening through which the small diameter portion of the rotary shaft passes, and is sandwiched between the large diameter portion of the rotary shaft and the impeller and attached to the rotary shaft.

According to the fifth aspect, the main body part can be attached to the rotary shaft without requiring any special parts, structures or the like.

A sixth aspect provides that in the pump of any of the second to fifth aspects, the main body part includes a fixing part that engages with the rotary shaft or the impeller so that the main body part does not move in a circumferential direction with respect to the rotary shaft or the impeller.

According to the sixth aspect, the fixing part allows the rotary baffle plate to be securely fixed so that the rotary baffle plate does not move in the circumferential direction with respect to the rotary shaft or the impeller.

A seventh aspect provides that in the pump of any of the second to sixth aspects, the main body part includes a curved relief portion near a base of the baffle plate part.

According to the seventh aspect, even if the baffle plate part is bent at right angles to the main body part, stress is inhibited from being concentrated on the base of the baffle plate part during operation of the pump. As a result, the baffle plate part can be prevented from being broken early.

An eighth aspect provides that in the pump of the first aspect, the impeller includes a main plate, and the baffle plate part is attached to the main plate of the impeller.

According to the eighth aspect, another part such as a rotary baffle plate does not need to be prepared separately, and the baffle plate part can mix water and air and efficiently discharge air with water from the pump 10.

A ninth aspect provides that in the pump of the first aspect, the shaft sealing device is a mechanical seal including a fixed ring and a rotating ring, and the baffle plate part is attached to the rotating ring of the mechanical seal.

According to the ninth aspect, another part such as the rotary baffle plate does not need to be prepared separately, and the baffle plate part can mix water and air and efficiently discharge air with water from the pump.

A tenth aspect provides that in the pump of any of the first to ninth aspects, the baffle plate part is oriented so that a main surface of the baffle plate part is parallel to an axial direction of the rotary shaft and a central axis of the rotary shaft is included in the same plane as the main surface.

According to the tenth aspect, the baffle plate part can efficiently stir water.

In an eleventh aspect, a rotary baffle plate that is attached to a rotary shaft so as to be located between an impeller and a shaft sealing device in a pump is provided. This rotary baffle plate includes a main body part including an opening into which the rotary shaft is inserted, and attached to the rotary shaft, and a baffle plate part attached to the main body part and extending in a direction that is inclined or orthogonal with respect to a surface orthogonal to an axial direction of the rotary shaft in a state where the main body part is attached to the rotary shaft.

According to the eleventh aspect, since the rotary baffle plate is attached to the rotary shaft, the baffle plate part rotates with the rotary shaft, and can therefore mix water and air between the impeller and the shaft sealing device and efficiently discharge air with water from the pump. Therefore, it is not necessary to process the casing or the impeller, for example, by making a hole, so that a decrease in pump efficiency due to this processing can be prevented, and cost required for the processing can be unnecessary.

REFERENCE SIGNS LIST

10 pump
31 rotary shaft
31*a* large diameter portion
31*b* small diameter portion
33 impeller
33*a* main plate
35 casing
36 upper casing
37 lower casing
38 mechanical seal
38*a* fixed ring
38*b* rotating ring
50 rotary baffle plate
51 baffle plate part
52 main body part
52*a* opening
53 curved relief portion
54 fixing part

The invention claimed is:

1. A pump comprising:

a rotary shaft, an impeller that is attached to the rotary shaft and that rotates with rotation of the rotary shaft, a casing that surrounds the rotary shaft, a shaft sealing device that seals a gap between the casing and the rotary shaft, a baffle plate part that is located between the impeller and the shaft sealing device and attached to a rotating body, the baffle plate part extending in a direction that is inclined or orthogonal with respect to a surface orthogonal to an axial direction of the rotary shaft, and a rotary baffle plate that is attached to the rotary shaft so as to be located between the impeller and the shaft sealing device, the rotary baffle plate including a main body part attached to the rotary shaft, and the baffle plate part provided on the main body part, wherein the main body part includes a curved relief portion near a base of the baffle plate part.

2. The pump according to claim 1, wherein the rotary baffle plate has a center of gravity that is present on a central axis of the rotary shaft.

3. The pump according to claim 1, wherein the baffle plate part extends from the main body part to a side of the shaft sealing device.

4. The pump according to claim 1, wherein the rotary shaft includes a large diameter portion, and a small diameter portion located on a tip side of the large diameter portion, and the main body part has an opening through which the small diameter portion of the rotary shaft passes, and is sandwiched between the large diameter portion of the rotary shaft and the impeller and attached to the rotary shaft.

5. The pump according to claim 1, wherein the main body part includes a fixing part that engages with the rotary shaft or the impeller so that the main body part does not move in a circumferential direction with respect to the rotary shaft or the impeller.

6. The pump according to claim 1, wherein the baffle plate part is oriented so that a main surface of the baffle plate part is parallel to an axial direction of the rotary shaft and a central axis of the rotary shaft is included in the same plane as the main surface.

7. A rotary baffle plate that is attached to a rotary shaft so as to be located between an impeller and a shaft sealing device in a pump, the rotary baffle plate comprising:

a main body part including an opening into which the rotary shaft is inserted, and attached to the rotary shaft, and a baffle plate part attached to the main body part and extending in a direction that is inclined or orthogonal with respect to a surface orthogonal to an axial direction of the rotary shaft in a state where the main body part is attached to the rotary shaft, wherein the main body part includes a curved relief portion near a base of the baffle plate part.

* * * * *